United States Patent [19]

Barnaby et al.

[11] 4,072,224

[45] Feb. 7, 1978

[54] PRINTING DEVICES

[75] Inventors: Bernard Sydney Barnaby, Ware; Cyril Walter Coe, Wembley; Godfrey Stephen Hall; John Harwood Leworthy, both of Newton Aycliffe, all of England

[73] Assignee: The General Electric Company Limited, London, England

[21] Appl. No.: 621,833

[22] Filed: Oct. 14, 1975

Related U.S. Application Data

[63] Continuation-in-part of Ser. No. 362,754, May 22, 1973, abandoned, and Ser. No. 497,530, Aug. 15, 1974, abandoned.

[30] Foreign Application Priority Data

| | | |
|---|---|---|
| May 24, 1972 | United Kingdom | 24431/72 |
| May 23, 1973 | Australia | 56056/73 |
| May 23, 1973 | Italy | 68511/73 |
| Aug. 17, 1973 | United Kingdom | 38970/73 |

[51] Int. Cl.[2] ..... B41J 3/04

[52] U.S. Cl. ..... 197/1 R; 101/93.05

[58] Field of Search ..... 197/1 R, 1.5; 101/93.04, 93.05

[56] References Cited

U.S. PATENT DOCUMENTS

| | | | |
|---|---|---|---|
| 2,656,240 | 10/1953 | Hell | 197/1 R |
| 2,658,106 | 11/1953 | Hell | 101/93.04 X |
| 2,659,652 | 11/1953 | Thompson | 101/93.04 X |
| 3,293,653 | 12/1966 | Amada | 101/93.04 X |
| 3,324,240 | 6/1967 | Kleinschmidt et al. | 101/93.04 X |
| 3,625,142 | 12/1971 | Bresler | 197/1 R X |
| 3,782,278 | 1/1974 | Barnett et al. | 101/93.04 |

*Primary Examiner*—Ralph T. Rader

*Attorney, Agent, or Firm*—Kirschstein, Kirschstein, Ottinger & Frank

[57] ABSTRACT

A tape printer which is for use with pressure-sensitive paper tape and which prints characters in the form of dots disposed in a 7 × 7 or 7 × 5 matrix has its printing elements formed by a stack of seven metal strips. Each of these strips has an associated electromagnet and upon energization of any one of these electromagnets the associated strip is moved longitudinally to cause the paper tape to be squeezed between an end of the appropriate strip and a rectilinear edge of a fixed anvil so as to cause a dot to be printed. The dimensions of such a dot are determined in one direction by the width of the operated strip and in the other direction by the width of the edge of the anvil. An electric motor is provided to advance the tape.

2 Claims, 7 Drawing Figures

PRINTING DEVICES

CROSS-REFERENCE TO RELATED APPLICATIONS

Figure 1:
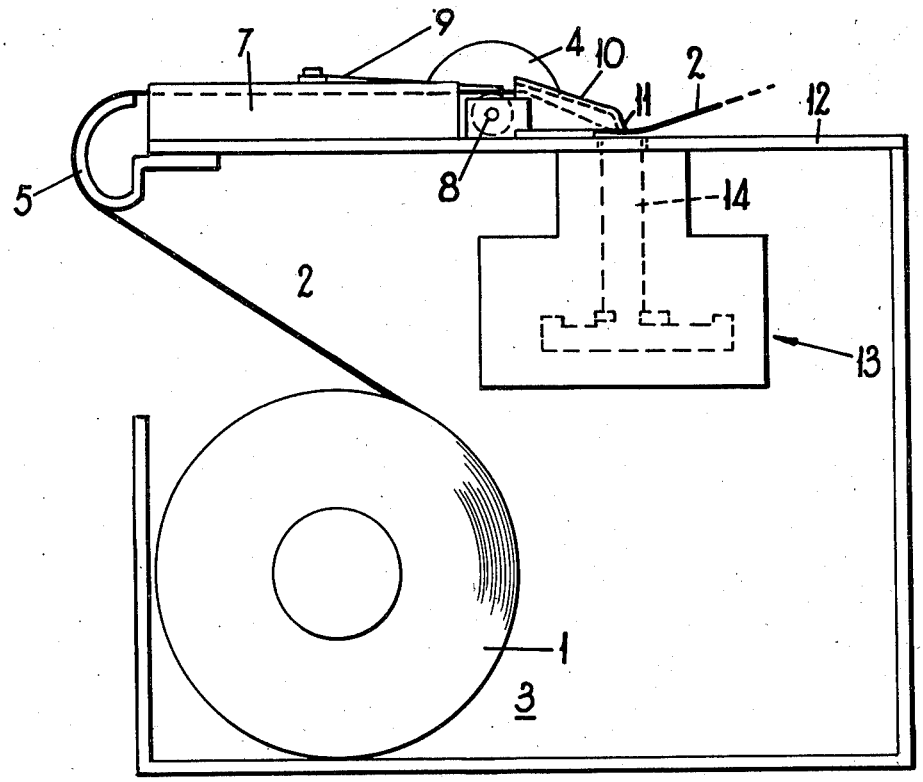

This application is a continuation-in-part of application Ser. No. 362,754 filed May 22, 1973 now abandoned for PRINTINT DEVICES by BERNARD SYDNEY BARNABY and CYRIL WALTER COE, and application Ser. No. 497,530 filed Aug. 15, 1974 now abandoned for PRINTING DEVICES by GODFREY STEPHEN HALL and JOHN HARWOOD LEWORTHY.

This invention relates to printing devices and is more particularly, but not exclusively, concerned with tape printers.

The invention is especially concerned with printing devices of the kind in which a plurality of printing elements are arranged to be selectively operated electromagnetically so as each to cause a mark to be printed on the paper or other material, the device having means to effect relative movement of the paper or other material relative to the printing elements so that a printed letter or character may be built up by successive operation of the printing elements upon such movement.

One example of a printing device of this kind is described and illustated in the specification of co-pending U.S. Patent Application Ser. No. 159,977 (now U.S. Pat. No. 3,804,224 issued Apr. 16, 1974). In that example, seven printing elements are disposed across the paper tape to be printed so that a character is printed in the form of a selection of dots in a 5 × 7 matrix as the tape is advanced, printing actually being effected by a selective movement of the printing elements (under the control of electromagnets) to cause a carbon paper ribbon to be pressed against the paper tape. The carbon paper ribbon may be dispensed with if the paper tape is pressure-sensitive.

In the printing device referred to in the last paragraph, each printing element is formed by an integral projection from a pivotted metal strip, the cross sectional dimensions of this projection determining the size of the dot that is printed by that printing element. It follows from this that the several similar projections that constitute all the printing elements must be accurately aligned with one another for satisfactory operation of the device. The present invention provides a printing device in which this difficulty is overcome.

According to the present invention, a printing device which is of the kind specified has a plurality of metal strips which lie parallel to one another and are mounted for limited movement, said strips each having an edge portion that constitutes one of said printing elements, and a fixed anvil which has a rectilinear edge that lies transverse to said strips and faces the edge portions thereof, the arrangement being such that, during use of the printing device the plurality of strips and the anvil lie on opposite sides of paper or other material to be printed so that marks are printed on the paper or other material by movement of the edge portions of the strips towards the anvil and the dimensions of each such mark is determined by the width of the edge portions of the strips and by the width of the edge of the anvil.

It will be appreciated that if the paper or other material to be printed is pressure-sensitive, the action of squeezing the paper or other material between the anvil and one of the strips causes a mark to be printed. If the paper or other material is not pressure-sensitive, it is necessary to provide printer transfer material (for example carbon paper) that passes together with the paper or other material to be printed between the strips and the anvil.

Figure 2:
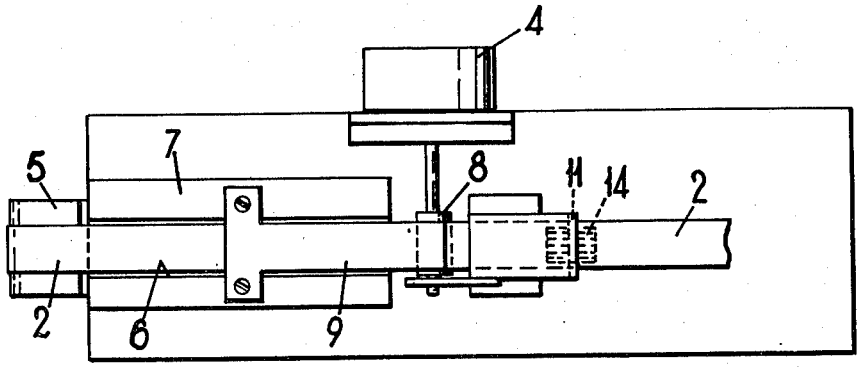
Figure 3:
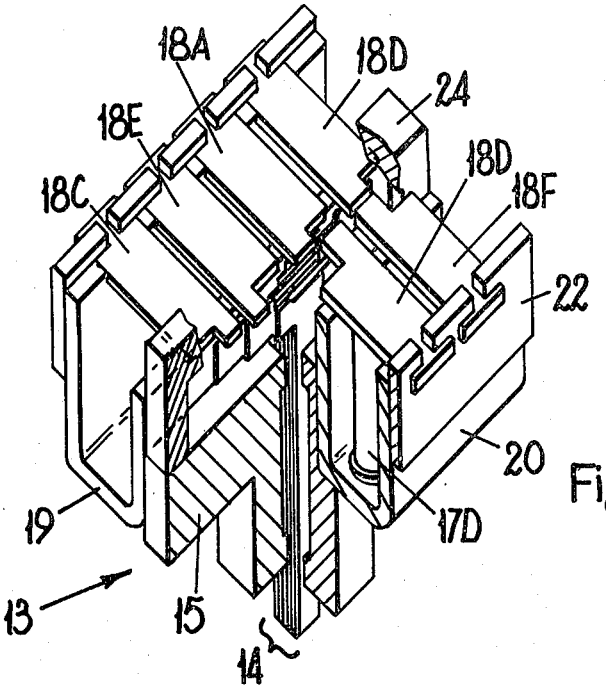
Figure 4:
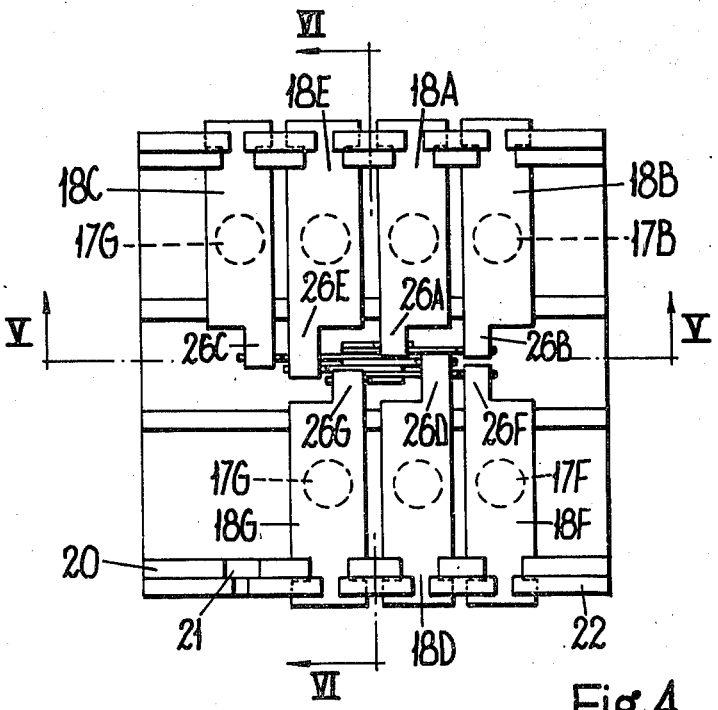
Figure 5:
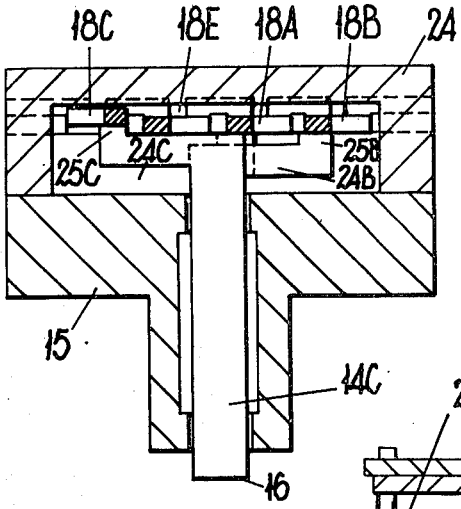
Figure 6:
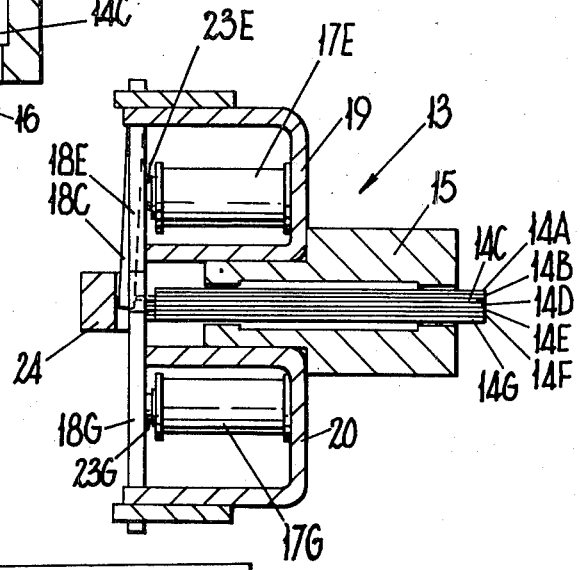
Figure 7:
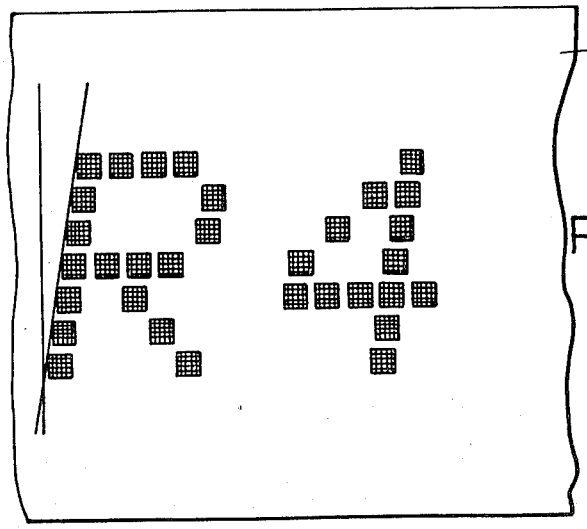

One embodiment of a tape printer according to the present invention will now be described by way of example with reference to the accompanying drawings in which FIG. 1 shows a side elevation of the printer, FIG. 2 shows a plan view of the printer, FIG. 3 shows an isometric view of the printing mechanism of the printer from underneath, FIG. 4 shows an underneath plan view of the printing mechanism with part removed, FIG. 5 shows a cross-section through the printing mechanism at the line V—V in FIG. 4, FIG. 6 shows a cross-section through the printing mechanism at the line VI—VI in FIG. 4, and FIG. 7 shows typical characters printed by the printer.

The tape printer now to be described is arranged to print a character in the form of a selection of dots disposed in a 5 × 7 (or 7 × 7) matrix, the printer having seven printing elements each of which is arranged successively to print the five (or seven) possible dots along one line of the character (i.e. along the length of the tape) as the tape is advanced.

Referring first to FIGS. 1 and 2 of the accompanying drawings, a spool 1 of pressure-sensitive paper tape 2 that is to be printed is carried in a compartment 3, the tape 2 being advanced through the printer by means of an electric stepping motor 4. After leaving the spool 1, the tape 2 passes over an arcuate member 5 and through a channel 6 in the member 7 to a rubber roller 8 which is driven by the motor 4, the paper 2 being pressed against the roller 8 by means of a resilient strip 9. From the roller 8 the tape 2 passes through a guide member 10 which serves to carry the tape under a narrow rectilinear edge 11 thereof which constitutes a stationary anvil that extends in a direction transverse to the direction of tape advancement. The members 7 and 10 are mounted on one side of a plate 12 while the printing mechanism 13 of the printer is mounted on the opposite side of that plate. As will subsequently be described more fully, the printing mechanism 13 has seven narrow metal strips 14 which lie parallel to one another in a stack and which constitute the printing elements of the printer. The seven strips 14 in fact project into an opening in the plate 12 so as to lie opposite the edge 11 of the member 10.

Referring now more particularly to FIGS. 3 to 6, the seven strips 14 (which in these figures are separately referenced 14A and 14G) are a sliding fit in a housing 15 of the printing mechanism 13, it being the ends 16 of the strips that lie opposite the edge 11 of the member 10 (FIG. 1) and constitute rectilinear narrow edge portions each of which includes a printing element which is the part of such edge portion that faces the anvil. It will be seen that the several strips form a stack the dimension of which perpendicular to the planes of the strips is parallel to the length of the anvil. The stack is in alignment with the anvil. The rectilinear narrow edge portions of the strips, and therefore the printing elements, are successively opposed to successive portions of the anvil along the length of the latter. In FIGS. 4, 5 and 6, the printing mechanism is shown with all the strips 14 except the strip 14C in their operated positions for making marks on the tape 2.

Longitudinal movement of the strips 14A to 14G is controlled by seven electromagnets 17A to 17G by way of co-operating armatures 18A to 18G. (For convenience, parts associated with operation of each of the strips 14A to 14G have the same suffix letters).

The longitudinal axis of electromagnets 17A to 17G all lie parallel to the lengths of the strips 14A to 14G. The electromagnets 17A, 17B, 17C and 17E are mounted on a U-shaped metal member 19 so that they are disposed in a line to one side of the stack of strips 14A to 14G while the electromagnets 17D, 17F and 17G are similarly mounted on a member 20 to lie on the opposite side of the strips.

The armatures 18D, 18F and 18G, for example, are shaped to loosely fit into slots corresponding to the slot 21 (which is not in fact used) in the member 20 and are held captive by means of a plate 22 which fits over the ends of the armatures and is secured to the member 20. This mounting arrangement for the armatures gives them freedom for the limited rotational movement in the plane of FIG. 6. Each of the armatures 18E to 18G is normally urged away from its associated electromagnet 17A to 17G by means of a helical compression spring contained within the electromagnet although only the springs 23E and 23G are shown in FIG. 6. Such movement of the armatures is limited by means of a stop bar 24 (which has been removed in the view of FIG. 4).

Each of the strips 14A to 14G has an arm portion (for example, the portions 24B and 24C in FIG. 5) and an upstanding portion (for example, 25B or 25C) which is arranged to be engaged by a finger 26 (see particularly FIG. 4) of the appropriate one of the armatures 18A to 18G. This arrangement ensures that when any one of the electromagnets 17A to 17G is energised, attraction of the associated armature 18 causes only the appropriate one of the strips 14 to be moved longitudinally.

The effect of longitudinal movement of any one of the strips 14A to 14G upon energisation of the appropriate one of the electromagnets 17A to 17G is, referring again to FIGS. 1 and 2, that the paper tape 2 is squeezed between the end 16 of the appropriate strip and the anvil. This causes a mark to be printed on the tape 2, the dimensions of this mark being determined in one direction by the width of the appropriate strip 14 and in the other direction by the width of the edge 11.

It will be appreciated that the printer described above may be used to print a character by simultaneously energising a selection of the electromagnets 17A to 17G to form a line of dots on the paper tape 2 at right angles to the length of the tape and repeating this operation (five or seven times in all depending on the matrix used) as the tape 2 is advanced through the printing station by operation of the stepping motor 4. Alternatively circuitry (not shown) may be provided to energise the electromagnets 17A to 17G sequentially so that by successively energising the electromagnets, as the tape is advanced, there is printed a line of dots that is slightly inclined and two examples of resulting characters (R4) are shown in FIG. 6 (using the 5 × 7 matrix). This alternative arrangement is particularly suited for use in circumstances in which the information for operating the printer is provided in serial form by a single electric signal which may be supplied over a telephone line, for example by a digital computer. This circuitry may also supply the necessary signals to the stepping motor 4 to advance the paper tape 2.

It may be mentioned that the printer is so dimensioned that each character printed thereby has a height of approximately three millimeters.

Although the printer described above is for use with pressure sensitive paper, it is to be understood that it may readily be modified for use with other paper. In that case it is necessary to provide a spool of disposable typewriter ribbon, this ribbon being advanced with the paper tape 2 so that the ribbon and the paper tape are squeezed together between the strips 14A to 14G and the anvil edge 11 whenever a mark is to be printed. Furthermore the printing mechanism may be replaced by one similar to that described in the previously mentioned specification in which the printing elements are pivotally mounted for rotational rather than linear movement, the only change necessary being that the projections from the strips that previously constituted the printing elements are replaced by rather wider projections (i.e. wider in the plane of the strip) so as to be similar to the ends 16 of the strips 14A to 14G of the presently described printer.

We claim:

1. A printer for a tape which constitutes an elongated web, said printer comprising:

A. tape transport means to advance the tape through a printing station at which the tape is movable in a plane in a direction parallel to the longitudinal axes of the tape, B. a single stationary anvil which has a narrow rectilinear edge and which is mounted at the printing station so that said edge lies adjacent and parallel to and to one side of said plane, the length of said edge of said anvil extending in a direction transverse to the direction of tape advancement; and C. a printer unit which is mounted at the printing station to lie on the opposite side of said plane to the anvil, said printer unit including:

i. a plurality of elongated narrow planar metal strips each having an end portion that constitutes a printing element;

ii. means to mount said strips to lie side-by-side in face-to-face contact in a stack, the dimension of which perpendicular to the planes of the strips extends in a direction parallel to the length of said rectilinear edge of said anvil for limited longitudinal sliding movement relative to one another and with said end portions thereof lying generally parallel to the direction of tape advancement and facing the rectilinear edge of said anvil, iii. a plurality of electromagnets forming a first group of electromagnets, iv. a plurality of further electromagnets forming a second group of electromagnets, v. means to mount said first and second groups of electromagnets so that the two groups are disposed on opposite sides of said stack of strips with the longitudinal axes of the electromagnets of both groups lying parallel to the lengths of said elongated strips, and vi. a plurality of armatures each having a projecting finger portion and each associated with a different one of said electromagnets of the first and second groups and with one of said strips, each armature lying with its finger portion adjacent the end of the associated strip remote from said end portion thereof so that upon energization of any one of the electromagnets during use of the printer unit, the attraction of the associated armature causes the finger portion of that armature to press against the end of the associated strip remote from said end portion and effect longitudinal movement of the associated strip towards said anvil to print a mark by cooperation of said end portion of that strip and said anvil and a character is printed by selective energization of said electromagnets of the first and second groups as the tape is advanced to cause a plurality of such marks to be printed each by cooperation of the end portion of the appropriate strip and said anvil;

vii. all of said strips cooperating during advance of said tape to form a single character.

2. A printer for a tape according to claim 1 including means to energize plural electromagnetic operating means concurrently to cause plural marks to be printed lying in a line along the length of rectilinear edge of said anvil.

* * * * *